United States Patent [19]

Morhard

[11] Patent Number: 4,616,540

[45] Date of Patent: Oct. 14, 1986

[54] METHOD AND APPARATUS FOR MAKING TUBES FORMED WITH HOLES IN THEIR PERIPHERAL WALL

[76] Inventor: Alfred Morhard, Koenigsberger Strasse 24, D-7272 Altensteig-Walddorf, Fed. Rep. of Germany

[21] Appl. No.: 608,596

[22] Filed: May 9, 1984

[30] Foreign Application Priority Data

May 11, 1983 [DE] Fed. Rep. of Germany ..... 3317313

[51] Int. Cl.[4] ..... B26F 1/04

[52] U.S. Cl. ..... 83/54; 234/78

[58] Field of Search ..... 83/54; 234/78

[56] References Cited

U.S. PATENT DOCUMENTS

| | | | |
|---|---|---|---|
| 1,510,718 | 10/1924 | Strong . | |
| 2,630,862 | 3/1953 | Musser . | |
| 3,259,003 | 7/1966 | Griffin | 83/54 |
| 3,538,735 | 11/1970 | Zimmerman . | |
| 3,678,718 | 7/1972 | Brown et al. | 83/54 X |
| 3,698,274 | 10/1972 | Coulon et al. | 83/54 X |

FOREIGN PATENT DOCUMENTS

| | | | |
|---|---|---|---|
| 2231517 | 1/1974 | Fed. Rep. of Germany . | |
| 2632713 | 1/1978 | Fed. Rep. of Germany . | |
| 2644130 | 4/1978 | Fed. Rep. of Germany | 83/54 |
| 2369029 | 6/1978 | France | 83/54 |
| 2371979 | 6/1978 | France . | |

OTHER PUBLICATIONS

Werkstatt und Betrieb, vol. 93, No. 4, Apr. 1960, p. 210, "Loch- und Praegewerkzeug . . . ".

"Fertigungstechnik", Oct. 1956, pp. 459 and 460.

"Luegers Lexikon der Gesamten Technik", 1928, pp. 724–729.

"Schnitt-, Stanz- und Ziehwerk-zeuge", 1972, pp. 134–150.

Leaflet: "Vollautomatische Vorschubeinrichtung für Lochreihen mit konstantem Teilschritt" (excerpt).

Leaflet: "Edel-Profilomat".

Leaflet: "Universal-Vielschnittstanze Type VM mit Schnellwechselwerkzeugträgern".

Leaflet: "Vorschublänge nach Bedarf, für 3–4–6 oder 8 Meter Länge in einem Durchgang" (excerpt).

Leaflet: "Edel-Profilomat-Stanzanlagen für kontinuierliche Lochabstände in Rohre, Profile und Flachmaterial".

Magazine Advertisement: "Wirtschaftliches Stanzen+Schneiden in der Profil- und Blechbearbeitung".

Press report: "Spezialwerkzeuge für den Stahlfenster- und Gewächshausbau" in International Industry and in Tube International (excerpt).

*Primary Examiner*—Donald R. Schran

*Attorney, Agent, or Firm*—Flynn, Thiel, Boutell & Tanis

[57] ABSTRACT

The invention relates to a method for making tubes formed with holes in their peripheral wall, particularly muffler tubes, in which the tubes are formed of sheet metal and subsequently welded along abutting edges of the sheet metal. Known from practical application is a method of the type defined above, in which a hole pattern is initially punched into a sheet metal strip. The metal strip is subsequently formed, as by a roll forming method, into tubes which are then closed by a longitudinal weld seam. After the welding step the tubes are cut to length by means of a cutting device, the operation of which is controlled depending on the hole pattern. It is the object of an invention to provide a method and apparatus of the type defined above which in addition to the advantage of economical production offers the possibility of forming the tubes with holes over their entire periphery. With regard to the method according to the invention, this object is attained by introducing a backing element into the previously welded tube and forcing it into engagement with the interior wall surface thereof, followed by the formation of holes from the exterior in the area of the tube supported by the backing element.

16 Claims, 5 Drawing Figures

METHOD AND APPARATUS FOR MAKING TUBES FORMED WITH HOLES IN THEIR PERIPHERAL WALL

FIELD OF THE INVENTION

The present invention relates to a method for making tubes formed with holes in their peripheral wall surface.

BACKGROUND OF THE INVENTION

Known from practical use is a method of the type defined above for making tubes to be employed in exhaust mufflers. A whole pattern desired for the finished tubes is punched into a flat metal strip. The strip is subsequently formed, as by a roll-forming method, to a tubular shape, its longitudinal edges being connected by a weld seam. Subsequent to the welding step, the tubes are cut to the desired length by means of a cutting apparatus, the operation of which is dependent on the hole pattern.

This known method suffers from certain drawbacks. As the introduction of the welding energy requires a continuous metal strip to be present along both sides of the weld seam, the rows of holes cannot be evenly distributed around the periphery.

The coordination of the various production steps likewise offers certain difficulties. The welding step requires a minimum feed velocity which is too high with regard to the hole formation in the metal strip by means of conventional punching presses. For this reason the metal strip is usually unwound from a coil, punched and rewound in a separate operation. As the hole patterns may vary with the type of tubes to be made, the punching operation can only be carried out in coordination with the type of tubes as ordered.

The accurate cutting of the tube to length depending on the hole pattern requires the employ of suitable scanning and aligning means.

The known method is thus relatively expensive and cumbersome and does not lend itself to the economical production of small numbers.

Known from U.S. Pat. No. 1,510,718 is an unrelated apparatus for forming holes in roller bearing cages. The cages are of frustoconical configuration and are to be formed with rectangular openings in their peripheral wall surface by a punching operation. The punching tool is inserted into the cage blanks and actuated in a radially outward direction, the outer periphery of the cage blanks being backed by a support element.

This known apparatus is only applicable in the case of workpieces suitable for being processed in a sideways direction and having an opening of a size permitting the tools for such processing to be inserted from the exterior into the interior of the workpiece, while the tool actuating mechanism remains substantially outside of the workpiece. The processing of the workpieces is additionally facilitated by the angular attitude of their peripheral wall with respect to their axis, as it permits the tools to be inserted throught the wider opening of the workpieces. The known apparatus is unsuitable, however, for forming holes in the peripheral wall of tubular workpieces having a substantially constant and relative narrow cross-section, as the tools can only brought to bear, if at all, adjacent the open ends of the tubular workpieces, but not in the axially intermediate region thereof.

SUMMARY OF THE INVENTION

It is therefore an object of the present invention to provide a method and apparatus of the type defined in the introduction, which in addition to being economically advantageous offer the possibility of forming holes in the peripheral wall of a tubular workpiece over the full axial length thereof and around the entire periphery.

To achieve this object, the invention provides that a backing element is introduced into the tubular workpiece and forced into engagement with the interior wall surface thereof, whereupon the tube wall area engaged by the backing element is formed with holes from the exterior.

The method according to the invention is very simple and offers various advantages. It is equally suited for seamless tubes and for tubes having a weld seam, the latter being formed and welded prior to the hole formation. The forming and welding steps can be carried out in an optimized operation independent of the hole formation. Tubes of standard diameters can be manufactured for storage and later processing. For finishing the tubular workpieces it is then sufficient to determine the tube length and to select the proper hole pattern.

With the employ of the method according to the invention, the manufacturer gains considerable organizational freedom and flexibility in the processing of the prefabricated tubes. The method lends itself to economical application for large-scale production as well as for the production of small numbers. This is a decisive factor with regard to cost-accounting. Follow-up orders of smaller numbers can be executed as economically as large-scale orders, as prefabricated tube blanks can also be employed for such follow-up orders and formed with the desired hole pattern on receipt of each such order.

With regard to hole formation the invention offers the decisive advantage that the tube may be formed with holes over its entire periphery. This permits the hole pattern to extend continuously along the periphery regardless of the weld seam, resulting in perfectly axial-symmetric hole patterns. Perforated tubes of the type described are usually employed also as muffler tubes. In this case, the noise-dampening properties are improved by the symetric hole pattern.

The invention also enables seamless tubes to be formed with holes in a simple manner. It is not to be feared that the tubes loose their cross-sectional shape during the hole-forming operation. The hole pattern can be selected in any suitable manner. Particularly in the case of muffler tubes it is possible to employ advantageously low-weight seamless aluminum tubes.

For the production of axial-symmetric workpieces formed with holes in their peripheral wall, the invention provides an apparatus comprising a punching tool and a retaining element located outside of the workpiece.

A backing element supported inside of the tube serves for backing up the tube wall to be formed with holes during the punching operation. The backing element thus secures the tube in position so as to prevent it from yielding during the punching operation. A pressure-engagement mandrel is operable during the punching operation to force the backing elements outwards and to retain them in their operating position.

The invention is applicable to tubes with and without a seam and with any conceivable cross-sectional shape.

It will mainly be employed, however, in the processing of tubes having circular cross-sectional shape.

Independent of the cross-sectional shape of the tubes it is possible in accordance with an advantageous embodiment of the invention to provide two backing elements disposed diametrally opposite one another with respect to the cross-sectional shape of the tubular workpiece and cooperating with a single pressure-engagement mandrel.

The paired arrangement of the backing elements and of the punching tools associated therewith offers the advantage that the punching forces act oppositely to each other, so that the forces exerted on the backing elements, the mandrel and any other components during the punching operation are equilibrated.

With regard to the punching operation it is advantageous to form the backing element as a punching die having a hole pattern. The hole pattern may selectively be formed in accordance with the demands of any given workpiece, or as an arrangement of closely spaced holes providing for any possible combination of hole positions. The design of the backing element in the form of a perforate punching die facilitates the punching operation, as it permits the punch scrap to be pushed through the die.

With regard also to the removal of the punch scrap it is advantageous to support the punching tool, the backing elements and the mandrel in a vertical position. In this case, the scrap produced by the punching operation is able to drop down under its own weight so as to be collected at a central location. The dropping-down of the scrap may in addition be accelerated by supplying a bore of the mandrel with pressurized air. The engagement actuation of the backing element is facilitated by forming each backing element with a saw-tooth shaped interior surface cooperating with a saw-tooth shaped outer surface of the pressure-engagement mandrel. As the pressure-engagement mandrel is displaced relative to the backing element, the oppositely facing saw-tooth profiles of the backing element and the mandrel ride up upon one another. The wedge-action produced by the axial displacement of the mandrel is effective to force each backing element radially outwards into engagement with the tube to be punched. Releasing the backing elements is carried out by reversing the displacement of the mandrel, whereby the saw-tooth profiles ride down on one another, permitting the backing element to withdraw from the workpiece.

Each backing element is preferably disposed within a guide half shell opening towards the workpiece and formed by the retaining element. The guide half shell is thus complementary to the backing element, with the workpiece located therebetween and retained thereby. The guide half shells are preferably formed so as to enable them to cooperate with tubes of varying cross-sectional shape and diameters. The retaining element supports the workpiece at least adjacent the location of the punching operation, in the present case thus mainly along an axially extending region. To this effect the retaining element could be of planar shape. The retainer element may of course also be shaped so as to conform to the shape of the workpiece, whereby it would be enabled to engage the workpiece outwards of the punching location. A simple mounting of the backing elements results from the provision that they are supported at the upper end of the respective guide half-shell. In this manner the workpieces may be inserted from below between the backing elements and the guide half-shells.

For ensuring accurate positioning of the punch elements of the punching tool, the guide half-shells are advantageously formed with guide openings for receiving the punch elements therein. As during the punching operation the guide half-shells are located closely adjacent the workpiece, they are able to accurately align and guide the punch elements of the punching tool.

In a particularly simple construction of the punching tool the punch elements are disposed above one another, particularly along an axially extending row with respect to the guide half-shells. This enables the punch elements to engage the workpice along an axially extending line thereon. As a result, it is sufficient to clamp the workpiece between the backing element and the respective guide half-shell along said axially extending line.

In order to ensure uniform engagement of the punching tool, the punch elements are preferably operatively connected to a common actuating element.

For permitting the punching elements to be selectively actuated, the actuating element may be provided with an activating bar effective to operatively connect to the actuating elements only those punch elements that are to be employed for punching a given workpiece. Other punch elements which, although provided on the punching tool, are not required for punching the respective workpiece will not be connected to the actuating element by the respective activating bars, so that they do not participate in the punching operation but remain at their rest positions.

For avoiding a non-uniform engagement of the workpiece, the actuating elements of two or more actuating elements are preferably connected to a common actuator means. This may be accomplished in a simple manner by the provision that the actuator means includes two slide wedges disposed adjacent the punching tools and cooperating with driven counterwedges. The counterwedges are preferably connected to a common yoke member cooperating with a punch drive assembly effective to actuate all of the punching tools so as to avoid non-uniform displacement thereof. At the saem time, this construction offers the possibility to provide a stroke adjuster element between the yoke member and the punch drive assembly for varying the stroke of the punching tools in correspondence to the properties of the workpieces to be punched.

The operating stroke may preferably be limited by providing spacer blocks between opposing guide half-shells. Such spacer blocks are effective to non-variably position the guide half-shells relative to one another by determining thefree space between guide half-shells disposed opposite one another. This space may be readily adjusted to different workpieces by suitably selecting the spacer blocks. The purpose of this adjustment may consist in locating the guide half-shells in such a manner that the workpiece is retained therebetween without being deformed. The spacer blocks are retained at centered positions by means of guide bars, so that the guide half-shells also assume an accurately centered position during the punching operation. This results in excentric forces being prevented from acting on the mandrel.

The feeding of workpieces is preferably accomplished by means of an elevator table carrying workpiece supports mounted for rotation about a vertical axis. The elevator table enables the workpieces to be introduced from below between the backing elements and the guide half-shells. Prefabricated tube sections may be mounted on the elevator table in the lowered stand-by position thereof. Automatic supply of the workpieces is also possible. For the punching operation proper, the elevator table is raised together with the workpieces mounted thereon, there being preferably the possibility to raise the workpieces to different levels for the punching operation so as to enable the holes formed along adjacent axially extending lines to be vertically offset with respect to one another. The rotary mounting of the workpiece supports permits the workpieces to be angularly indexed individually or collectively after the punching of each vertical row of holes for the subsequent punching of further rows of holes.

For ensuring alignment of the workpiece supports with the mandrel, each workpiece support is preferably formed with a centering recess for the mandrel. Centering of the mandrel takes place as the elevator table is being raised.

BRIEF DESCRIPTION OF THE DRAWINGS

An exemplary embodiment of the invention shall now be described with reference to the accompanying drawings, wherein.

DETAILED DESCRIPTION

The apparatus 1 according to the invention serves for making tubes formed with holes in their peripheral walls, particularly for making muffler tubes. The tubes themselves are formed of metal sheet separate from the apparatus and subsequently welded along an abutment line. The invention is also applicable, however, to the processing of seamless tubes. In each case the tubes are already cut to length preparatory to being processed with the aid of the apparatus according to the invention.

Figure 1:
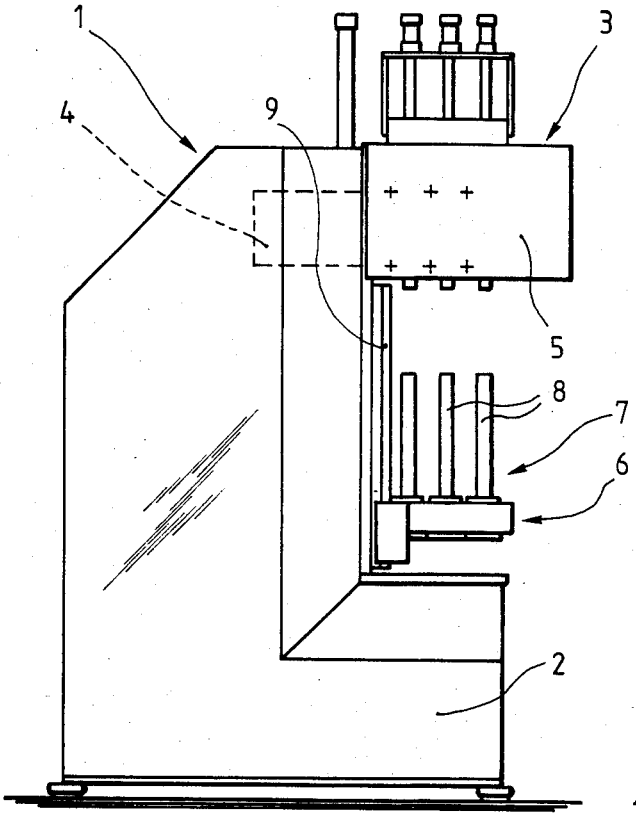
FIG. 1 shows an elevational side view of an apparatus according to the invention.

As particularly shown in the elevational side view of FIG. 1, apparatus 1 comprises an L-shaped frame 2. In the emodiment shown, apparatus 1 is designed as a multiple tube punching device. Located in the upper half of the space defined by L-shaped frame 2 are three pairs of punching tools 3 disposed in side-by-side relationship and adapted to be actuated by a common actuator means 4 in a manner to be described. Punching tools 3 are mounted in a support 5 disposed at the upper end of the vertical leg of L-shaped frame 2 so as to extend above the space defined by L-shaped frame 2 somewhat beyond the horizontal leg thereof.

An elevator table 6 disposed below support 5 carries a row of three workpiece supports 7 for mounting a workpiece 8 thereon.

In the present case, workpieces 8 are in the form of three sections of the cylindric tube of equal length. They are mounted on supports 7 at accurately vertical positions. Details of elevator table 6 and workpiece supports 7 will be discussed as the description proceeds.

Elevator table 6 is adapted to be raised and lowered along a pair of vertical guides 9 extending parallel to the vertical leg of L-shaped frame 2 at a constant spacing relative to each other.

Thus far the overall construction of apparatus 1 has been described. Next to be described are initially the punching tools and other components associated therewith.

In the apparatus shown, punching tools 3 are disposed in pairs. This is particularly evident from FIG. 3. Shown therein are three work stations 10, 11, and 12 each provided with two punching tools 3 disposed opposite one another.

Each work station is operable to form a workpiece, in the present case a cylindrical tube section 8, with a predetermined hole pattern, with the hole patterns of individual workpieces not being necessarily identical.

Located at the center of each work station is a mandrel 13 (FIG. 4) extending upwards from the respective station and being mounted on a cross member of support 5 for vertical reciprocating displacement by means of adjustment devices 14. In the present case mandrel 13 is of circular cross-sectional shape. Along its longitudinal center axis, mandrel 13 is formed with a bore 15 extending over its full length and permitting the punch scrap to drop therefrom in a manner to be described.

The outer surface of vertically aligned mandrel 13 is formed with a saw-tooth shaped profile comprising a number of teeth tapering downwards at a small angle. Adjacent the location of the teeth, mandrel 13 is provided with a slot 17 formed in a peripheral portion facing the respective punching tool 3 for permitting punch elements 16 associated with tool 3 to pass therethrough together with the punch scrap.

Mandrel 13 acts as a central actuating element for a pair of backing elements 18 located adjacent opposite sides thereof. Backing elements 18 are formed as vertical bars having a substantially rectangular cross-sectional shape. One side of the rectangle is rounded so as to conform to the interior wall surface of a workpiece to be processed.

Backing elements 18 may be supported in vertical grooves of mandrel 13. At the side of their rectangular cross-section facing towards the center of mandrel 13, they are formed with a saw-tooth shaped surface corresponding to the saw-tooth shaped outer surface of mandrel 13 in such a manner that the teeth of these two surfaces are engageable with each other. That is, the saw-teeth of backing elements 18 taper upwards at a small angle.

Backing elements 18 serve as countersupports for punching tools 3. As mandrel 13 is displaced vertically downwards, its teeth ride up on those of backing elements 18, whereby the latter are forced radially outwards into engagement with the tubular workpiece. In the embodiment shown, such engagement takes place at least along an axially extending line to be formed with punched holes in a predetermined pattern.

Backing elements 18 are disposed diametrally opposite one another with respect to the tubular cross-section of the workpiece. They are each formed as a punching die having a specific hole pattern. The hole pattern comprises a row of holes formed above one another at predetermined spacings.

While backing elements 18 serve for supporting the tubular workpiece at the interior wall surface thereof, the support of the workpiece from the exterior thereof is accomplished by means of a pair of guide half-shells 19 of U-shaped cross-sectional configuration with their open sides facing towards the workpiece. The U-shape of the cross-section is selected to accommodate the diameter and cross-sectional shape of the biggest possible workpiece so as to peripherally engage the latter. In the case of a tubular workpiece having a smaller diameter, guide half-shells 19 come into engagement therewith only along the axially extending line to be formed with holes. Guide half-shells 19 are provided with horizontal passages for punch elements 16 of punching tools 3 to extend therethrough. These guide passages are formed similar to the hole pattern of backing elements 18 above one another in a vertical row at a spacing corresponding to that of the holes forming the hole pattern of backing elements 18.

At their upper ends backing elements 18 are provided with hooks 20 projecting radially outwards and engaged in complementary openings of the respective guide half-shell 19. In this manner backing elements 18 are supported by guide half-shells 19 in a manner permitting them to be radially displaced. This displacement is necessary for providing sufficient space between backing elements 18 and guide half-shells 19 for the workpieces to be advanced and retracted therebetween.

Punch elements 16 of punching tools 3 are disposed vertically above one another similar to the passages of Backing elements 18 and guide half-shells 19. Punch elements 16 are supported in horizontal orientation and extend from the respective guide half-shell 19 radially outwards to a common actuating element 21 formed as a vertical pressure bar. For the selective actuation of punch elements 16 actuating element 21 contains a vertical activating bar 22 for operatively connecting predetermined punch elements with actuating elemetn 21. Activating bars 22 are adapted to be inserted from above into a groove of the respective actuating element 21 and formed with openings for each punch element 16 not required for a specific punching operatation, so that these punch elements are not actuated on horizontal displacement of actuating element 21.

Figure 3:
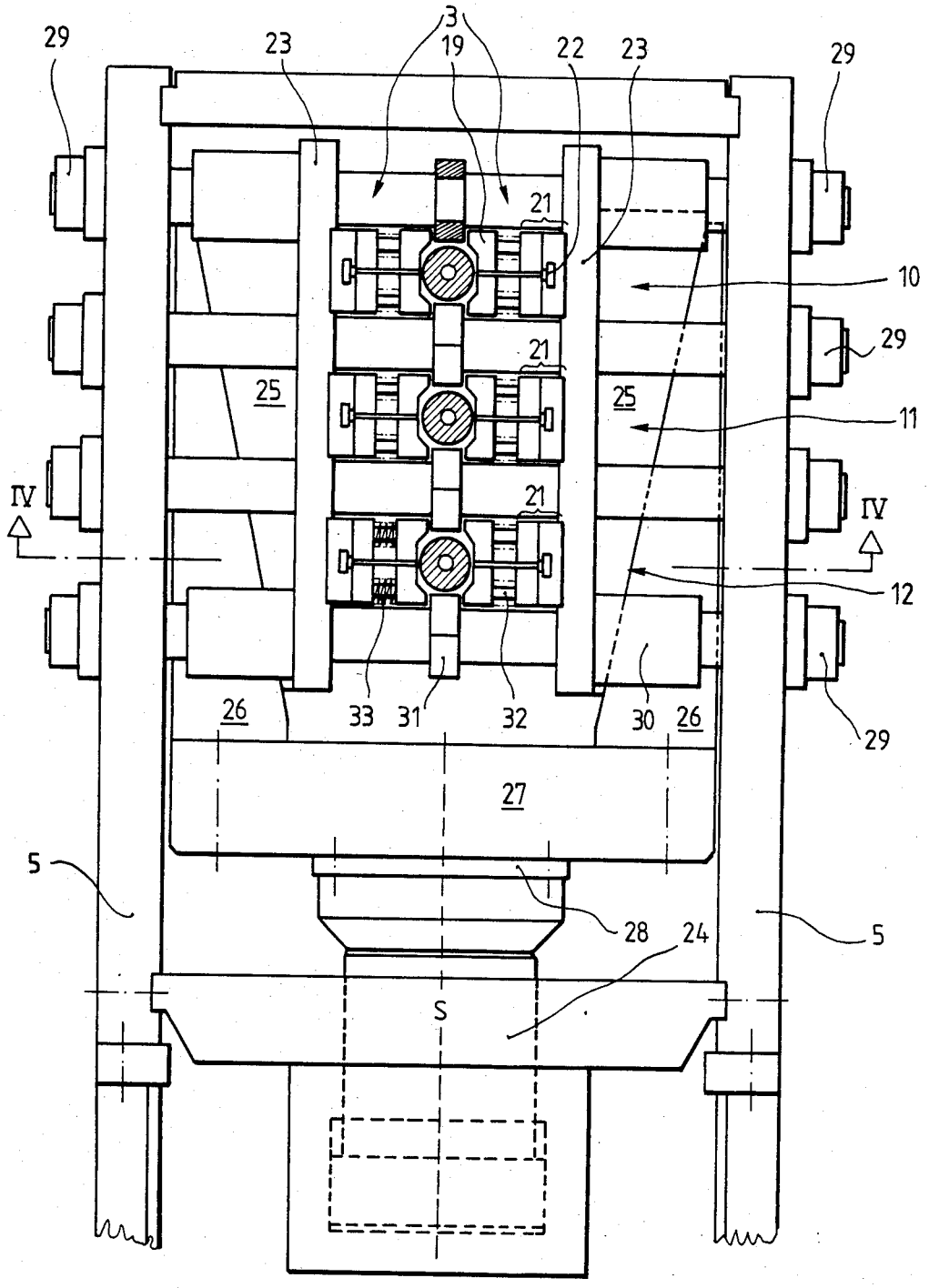
FIG. 3 shows a partial top plan view of the punching tools of the apparatus of FIG. 1 taken along the line III—III in FIG. 4.

As shown in FIG. 3, a pressure plate 3 is disposed rearwards of the actuating elements 21 located to one side of the symmetry axis S of frame 2, said pressure plate 23 extending over the full height of punching tools 3 and projecting beyond the ends of the three work stations 10, 11 and 12 in the horizontal direction. In the present case, pressure plate 23 extends over three punching tools 3 associated with the respective work stations 10, 11, and 12, so that equal forces may be applied to the tools on actuation thereof.

This effect is accomplished not only by the simultaneous and uniform actuation of the punching tools of each side through the employ of a common pressure plate, but also by the provision of a central drive means 24 operatively connected to all of the punching tools for simultaneous and uniform actuation thereof. Means connecting drive means 24 to the punching tools comprise a slide wedge 25 secured to the outer surface of each pressure plate 23 and having a vertical wedge surface tapering in the direction towards drive means 24. Slide wedges 25 cooperate with counter-wedges 26 tapering in the opposite direction and engaging the tapered surfaces of slide wedges 25. The opposite surfaces of counterwedges 26 are in engagement with support plates 5. The enlarged base ends of counterwedges 26 are secured to a common yoke member 27 operatively connected to drive means 24 through a stroke adjuster element 28. Stroke adjuster element 28 may be formed as a threaded connection between yoke member 27 and a plunger of drive means 24 and serves essentially for adjusting the stroke as required by the shapes and dimensions of the workpieces to be processed.

Figure 4:
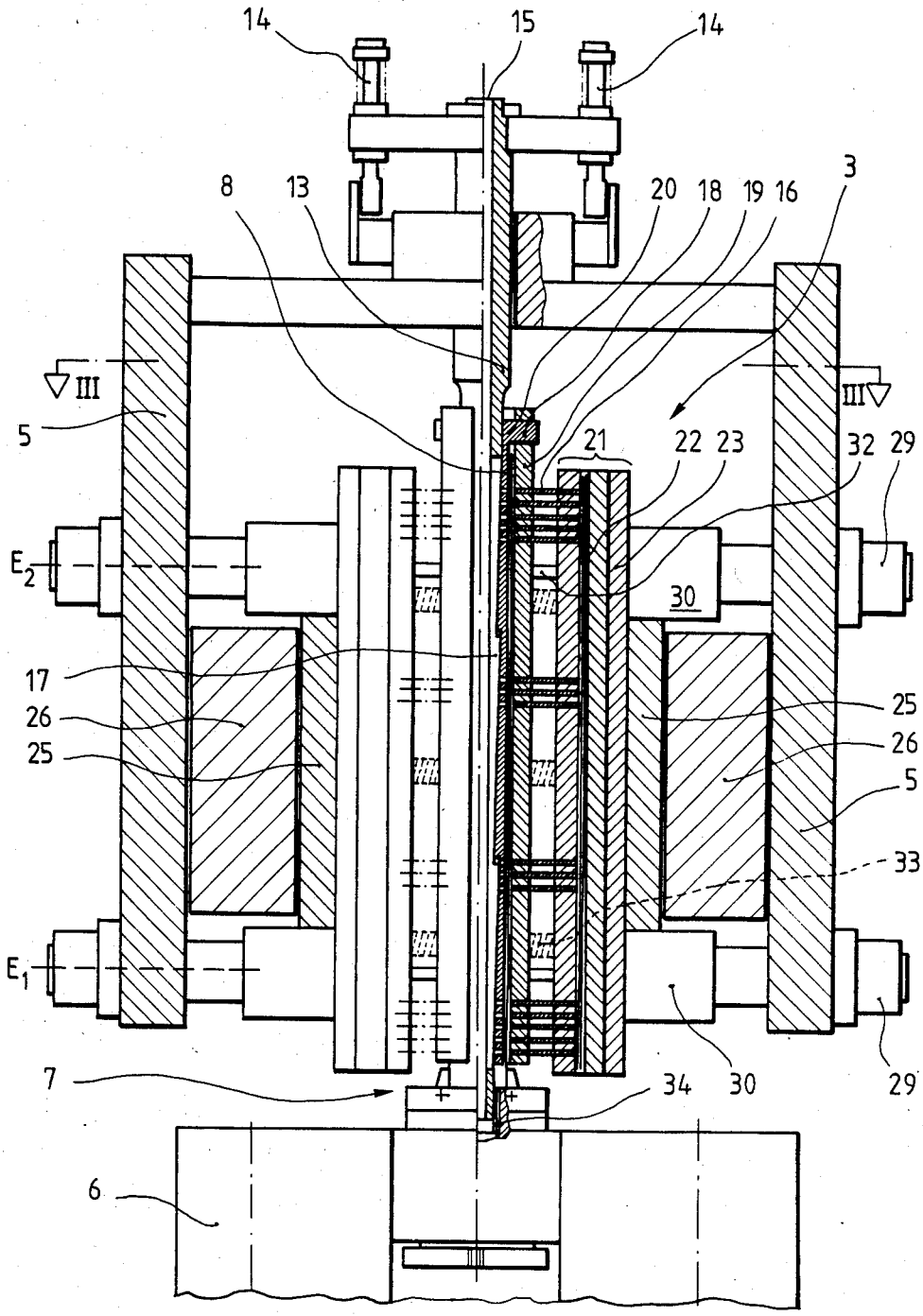
FIG. 4 shows a sectional view of the components shown in FIG. 3 taken along the line IV—IV.

As shown in FIGS. 3 and 4, support plates 5 are connected to one another by a plurality, in the present case eight, of tension bolts 29. Four of these tension bolts are located in a lower plane E1 extending in horizontal direction adjacent the lower ends of punching tools 3 as shown in FIG. 4. Four other tension bolts are located in an upper plane E2 extending adjacent the upper ends of punching tools 3. Slide wedges 25 and counterwedges 26 are located between these two planes E1 and E2.

Tension bolts 29 are of columnar shape and rigidly connected to support plates 5. These columns serve for mounting various components, for instance pressure plates 23 which are slidably mounted with the aid of bushings 30 on the respective outer columns of upper and lower planes E2 and E1, respectively.

Additionally mounted on the columns in a symmetric arrangement with respect to the symmetry plane S are spacer blocks 31 shown in the present embodiment in the form of bar-shaped members fixedly retained in the symmetry plane S by being engaged with annular recesses formed on tension bolts 29 (see cross-sectional view of FIG. 3, above). Spacer blocks 31 serve as stroke limiters for guide half-shells 19, the latter being connected to actuating elements 21 through horizontal carrier rods 32. This connection is not rigid, however, permitting actuating elements 21 to be displaced in the direction towards guide half-shells 19 against the force exerted by springs 33 located between guide half-shells 19 and actuating elements 21.

Spacer blocks 31 project into the path of guide half-shells 19 so as to determine the end positions thereof as dictated by the shape and dimensions of the workpiece to be processed. This serves to prevent the workpieces from being deformed during the punching operation.

Thus guide half-shells 19, actuating elements 21 and slide wedges 25 are also mounted on tension bolts 29 through pressure plates 23 for horizontal displacement therewith.

Figure 2:
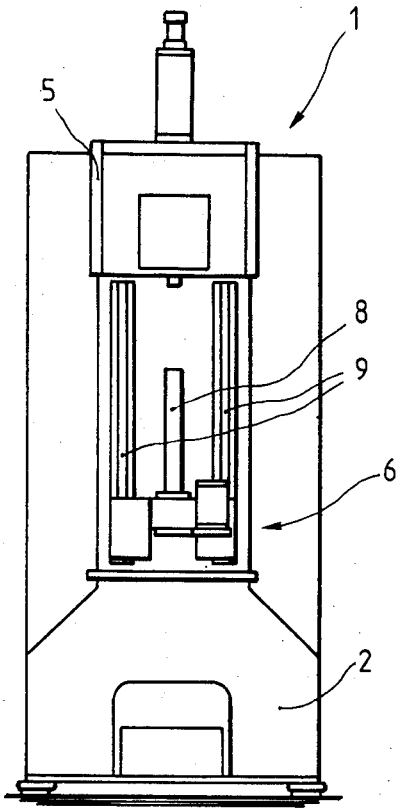
FIG. 2 shows a front elevational view of the apparatus of FIG. 1.

In FIGS. 1 and 2, elevator table 6 is shown in its lower stand-by position permitting workpieces to be mounted on supports 7 and removed therefrom.

FIG. 4 of the drawings shows elevator table 6 in its raised operating position. In this position, table 6 has been raised to the lower end of punching tools 3, and workpiece 8 has been inserted between backing elements 18 and guide half-shells 19 to a height permitting it to be formed with the required holes over its full length. For rigidly securing the lower end of mandrel 13, each support 7 is provided with a centering recess 34 for receiving the lower end of mandrel 13 in the operating position of elevator table 6 and securing it against sideways displacement.

Supports 7 are further provided with a passage coaxially aligned with through-bore 15 for the punch scrap to drop therethrough.

Figure 5:
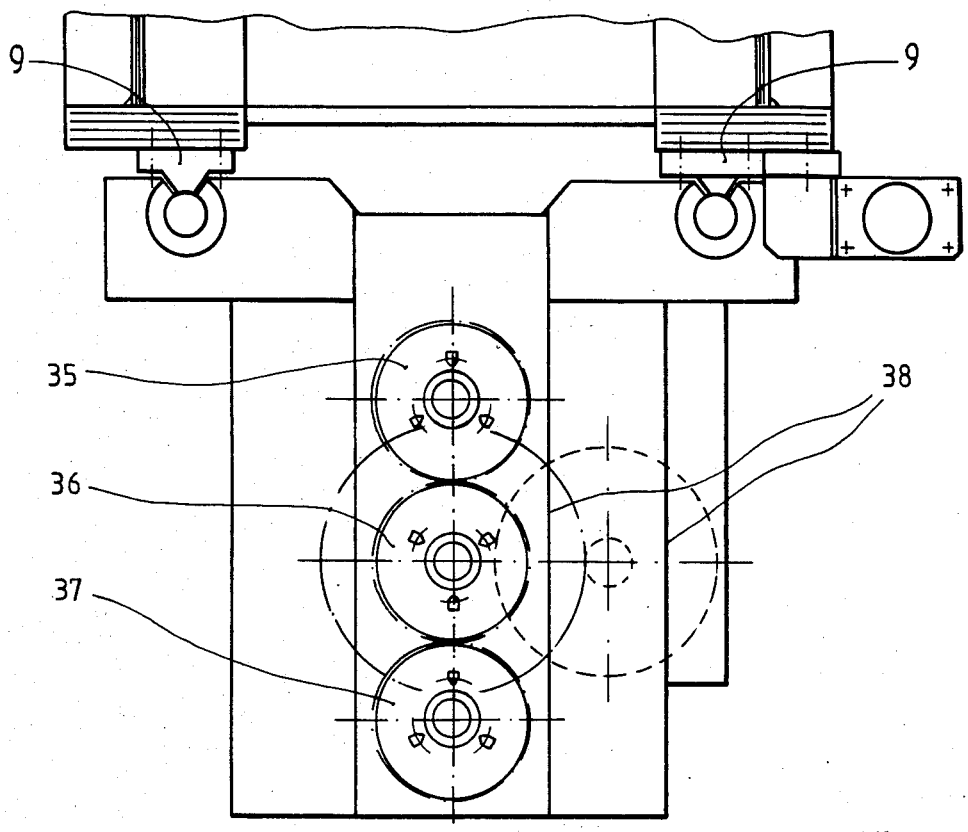
FIG. 5 shows a partial view of adjustment drive means for the workpiece supports.

Diagrammatically shown in FIG. 5 is the angular indexing drive means for supports 7 of table 6. The three supports are each mounted for rotation about a vertical axis and operatively connected to one another by means of gears 35, 36 and 37 meshing with one another. A reduction gear assembly 38 connects the center support to a step motor operable to angularly index the workpieces for the punching operation. Since during each punching operation only the holes located along an axially extending line of the workpiece are formed, the angular indexing of the supports permits the entire peripheral wall of the workpieces to be formed with holes.

In the support indexing arrangement shown, adjacent workpieces are driven to rotate in opposite directions. Should this be considered undesirable, it is also possible to provide indexing means for rotating all workpieces in the same direction. It may also be possible to provide a continuously controllable non-stepping drive source in place of a stepping motor.

In the method according to the invention, tubular workpieces are initially formed of a metal strip or other suitable sheet metal blanks, and welded along abutting edges. In a subsequent step the tubular workpieces may be cut to length. For punching the holes, a backing element is inserted into the previously welded tube, and forced into engagement therewith. The punching operation is carried out from the exterior, with the backing element serving as a countersupport for retaining the workpiece and for absorbing the punching forces. For simple removal of the punching scrap by the action of gravity the tube is held in a vertical position during the punching operation. For achieving equilibration of forces, if desired, the tube may be simultaneously formed with holes from two mutually opposite directions.

In operation of the apparatus according to the invention, the prefabricated workpieces, for instance welded or seamless tubes, are mounted from above on supports 7 of elevator table 6 and clamped therein in vertical alignment, with the table 6 being in its lowered stand-by position as shown in FIGS. 1 and 2. After the workpieces have been thus secured, elevator table 6 is vertically raised so as to introduce the workpieces between backing elements 18 and guide half-shells 19 to a height required for the punching operation to be carried out. Raising of elevator table 6 results in mandrel 13 being centered in the centering recess of the respective workpiece support 7. For forcing backing elements 18 into engagement with the workpiece, mandrel 13 is displaced downwards by means of adjustment device 14, causing the saw-teeth to ride up upon one another to force backing elements 18 radially outwards into engagement with the workpiece.

On subsequent actuation of the central actuating drive 24 for punching tools 3, yoke member 27 is forcibly advanced in the direction towards punching tools 3. This causes counterwedges 26 to ride up on slide wedges 25, resulting in pressure plates 23 being displaced in the direction towards the workpieces.

As actuating elements 21 are advanced towards workpieces 8, guide half-shells 19 approach the tube to be formed with holes so as to clamp it against backing elements 18. At the same time, guide half-shells 19 come into engagement with spacer blocks 31 serving as stroke limiting elements for guide half-shells 19. Subsequent reduction of the distance between actuating elements 21 and guide half-shells 19 results in springs 33 disposed therebetween being compressed. Springs 33 are precompressed to such a degree that they are able to absorb any non-uniform lateral forces so as to reduce the forces acting on mandrel 13.

The punch elements 16 required for punching the respective workpiece are rigidly connected to the associated actuating element 21 by means of activating bar 22, so that only these punch elements are advanced towards the workpiece for punching the desired holes therein. The stroke of punching tools 3 is selected so that punch elements 16 penetrate into mandrel 13 for delivering the punch scrap to vertical passage 15. The scrap subsequently drops out of the apparatus through the passage formed in support 7.

The described first stroke resulted in holes being punched along two axially extending lines diametrally opposite one another. For punching further holes along other axially extending lines, punching tools 3 have to be retracted out of engagement with the workpiece. Subsequently each workpiece may be angularly indexed by a predetermined step through actuation of the central workpiece support drive means, whereupon the stamping operation is repeated as described above.

The return stroke of punching tools 3, irrespective of whether between successive punching operations or at the end of the overall operation, is initiated by retracting the plunger of central actuating drive means 24 together with yoke member 27 and counterwedges 26. This permits springs 33 supported on guide half-shells 19 themselves fixed in position by spacer blocks 31 to push actuating elements 21 outwards, whereby punch elements 16 are at least partially retracted from the workpieces. Although the return stroke is generally accomplished by means of the wedge transmission arrangement.

After the punching operations have been finished, elevator table 6 is again lowered from the operating position shown in FIG. 4, whereby mandrels 13 are released from their centering engagement. The finished workpieces may now be removed from workpiece supports 7.

The apparatus according to the invention offers the possibility of short-time planning to manufacturers and customers. Also possible is a rapid tool change for punching holes of different diameters. Various hole patterns may be achieved by simply changing activating bars 22. The apparatus is of relatively compact construction and constitutes a relatively inexpensive investment, permitting also small numbers of workpieces to be processed in an economical manner.

A decisive advantage of the invention consists in the fact that the workpieces may be formed with holes over their entire periphery. The apparatus is able to process welded tubes as well as seamless tubes made of various materials, specifically also tubes made of aluminum.

The embodiments of the invention in which an exclusive property or privilege is claimed are defined as follows:

1. An apparatus for perforating an elongate tube, comprising: an elongate mandrel having first and second ends and support means cooperable with said first end of said mandrel for supporting said mandrel, the tube being axially slidable over said second end of said mandrel, said mandrel including two elongate, axially extending backing elements and means for effecting radially outward movement of said backing elements in opposite directions so that said backing elements engage the inner surface of the tube at diametrically opposite regions thereof which are each to have holes punched therein; two elongate, axially extending guide elements which are provided on opposite sides of and are supported for radial movement toward and away from said mandrel, each said guide element being approximately angularly aligned with a respective one of said backing elements and being engageable with the exterior surface of the tube; a plurality of punch elements supported on ech of said guide elements at axially spaced locations therealong for generally radial movement toward and away from said mandrel; actuating means which can effect simultaneous radially inward movement of at least one of said punch elements on each of said guide elements, said actuating means including selecting means for selecting a predetermined group of said punch elements on each said guide element which are simultaneously moved radially inwardly by said actuating means, wherein each said punch element which is excluded from said predetermined groups remains in a radially outer position during radially inward movement of said predetermined groups of punch elements, each of said punch elements of said preselected groups punching a hole through said tube during said radially inward movement thereof; and means which cooperates with said second end of said mandrel as said actuating means effects radially inward movement of said punch elements for holding said second end of said mandrel against movement in radial directions as said punch elements punch holes in the tube.

2. The apparatus according to claim 1, wherein said mandrel includes an elongate, axially extending mandrel element disposed between said backing elements and supported for axial movement, said means for effecting radially outward movement of said backing elements including sawtooth shaped surface provided on each side of said mandrel element and extending axially therealong, each of said sawtooth shaped surfaces on said mandrel element slidably engaging a sawtooth shaped surface provided on a respective one of said backing elements, so that axial movement of said mandrel element effects simultaneous radial outward movement of said backing elements.

3. The apparatus according to claim 1, wherein said mandrel element extends vertically and has a central opening extending axially therethrough, said backing elements each having a plurality of passages which extend radially therethrough and can receive the radially inner end of a respective one of said punch elements, said mandrel element having means defining openings therein which permit waste material punched from the tube to move from said passages in said backing elements into said central opening through said mandrel element and to drop through said central opening in said mandrel element in response to the force of gravity.

4. The apparatus according to claim 3, wherein said first end of said mandrel is the upper end thereof; including table means disposed below said mandrel and movable vertically relative to said mandrel between a lower position spaced downwardly from said second end of said mandrel and an upper position in which said second end of said mandrel is disposed in a recess provided in said table means, said recess being said means for holding said second end of said mandrel against radial movement; and including means on said table means for supporting a tube which is to be perforated in a vertical position directly above said recess in said table means and coaxial with said mandrel, the tube moving over said mandrel during upward movement of said table means to its upper position.

5. The apparatus according to claim 4, wherein said means for supporting a tube on said table means includes angular indexing means for effecting a predetermined amount of angular rotation of the tube after a punching operation utilizing said punch elements has been completed.

6. The apparatus according to claim 5, wherein said support means has two said mandrels supported at spaced locations thereon and extending parallel to each other, wherein said table means has two said recesses therein which can each receive said second end of a respective one of said mandrels, and wherein said means for supporting a tube on said table means is adapted to support two tubes vertically on said table means so that each tube is disposed above a respective said recess therein and is coaxially aligned with a respective one of said mandrels, and wherein said angular indexing means is operatively coupled to each of said tubes for simultaneously effecting rotation thereof, said indexing means including two meshing gears which are rotatably supported on said table means for rotation about respective vertical axes which are each coaxial with a respective one of said mandrels, each said gear having a respective one of said tubes supported thereon and rotatable therewith, said indexing means further including means for effecting a predetermined amount of rotation of one of said gears.

7. The apparatus according to claim 1, wherein said actuating means includes two actuating members disposed on diametrically opposite sides of and supported for radial movement toward and away from said mandrel, each said actuating member being angularly aligned with and disposed radially outwardly of a respective one of said guide elements, and selectively actuable drive means for effecting simultaneous radially inward movement of each of said actuating members when holes are to be punched in a tube, and wherein said selecting means includes an activating bar removably supported on each said actuating member and having portions which engage each of said punch elements of the preselected group of punch elements on the associated guide element during radially inward movement of said actuating members so as to effect radially inward movement of said preselected groups of punch elements, each said punch element excluded from said preselected groups being free of engagement with said activating bars during radially inward movement thereof.

8. The apparatus according to claim 7, including resilient means for yieldably resisting radially inward movement of said actuating members relative to said guide elements.

9. The apparatus according to claim 8, wherein said resilient means includes a plurality of helical compression springs which each have one end supported on one of said guide elements and the other end supported on the actuating member associated therewith.

10. The apparatus according to claim 7, wherein said actuating means includes two wedges which can each operatively engage a respective one of said actuating members on a side thereof remote from said mandrel, two movably supported counterwedges which each engage a respective one of said wedges on a side thereof remote from said mandrel, a yoke which extends between and couples said counterwedges, and selectively actuable punch drive means for effecting simultaneous movement of said yoke and counterwedges, said punch drive means including stroke adjuster means for effecting adjustment of an initial position of said yoke.

11. The apparatus according to claim 10, including a further mandrel which is spaced from and parallel to said first-mentioned mandrel, a plurality of further punch elements and two further diametrically opposed actuating members associated with said further mandrel, said wedges being engageable with said further actuating members, and movement of said counter-wedges causing said wedges to engage and effect radially inward movement of said further actuating members simultaneously with radially inward movement of said first-mentioned actuating members.

12. The apparatus according to claim 7, wherein each of said guide elements has a plurality of openings which extend radially therethrough and which each have a respective one of said punch elements slidably supported therein.

13. The apparatus according to claim 7, including two elongate carrier members which are disposed on opposite sides of and extend parallel to the directions of movement of said guide elements, said guide elements and said actuating members being slidably supported on said carrier members, and including a respective spacer block supported on each of said carrier members in the region of said mandrel, said spacer blocks being engaged by and limiting radially inward movement of said guide elements.

14. The apparatus according to claim 7, wherein each of said guide elements is approximately U-shaped in cross section and opens toward mandrel.

15. The apparatus according to claim 1, including angular indexing means for effecting a predetermined amount of angular movement of a tube supported on said mandrel after a plurality of holes have been produced in the tube by said punch elements.

16. The apparatus according to claim 1, wherein said mandrel and said guide elements are shaped to cooperate with a tube having a circular cross section, each of said backing elements of said mandrel having a radially outwardly facing surface thereon which is curved to conform to and is engageable with the inner surface of the tube.

* * * * *